US005291917A

United States Patent [19]

Yamanaka

[11] Patent Number: 5,291,917

[45] Date of Patent: Mar. 8, 1994

[54] HOUSING FOR A VACUUM VALVE UNIT

[75] Inventor: Junichi Yamanaka, Aichi, Japan

[73] Assignee: Inax Corporation, Tokoname, Japan

[21] Appl. No.: 992,745

[22] Filed: Dec. 18, 1992

[30] Foreign Application Priority Data

Mar. 30, 1992 [JP] Japan ..... 4-74090

[51] Int. Cl.[5] ..... F16L 5/00; B67C 3/16

[52] U.S. Cl. ..... 137/363; 137/205; 137/236.1

[58] Field of Search ..... 137/205, 236.1, 363, 137/364, 365, 366, 367

[56] References Cited

U.S. PATENT DOCUMENTS 1,325,393 12/1919 Calhoun ..... 137/369
3,112,760 12/1963 Budd ..... 137/363
3,974,599 8/1976 Grosh .
4,373,838 2/1983 Foreman et al. ..... 137/236.1
4,905,725 3/1990 Sinkinson et al. ..... 137/365
4,976,366 12/1990 Russell .

FOREIGN PATENT DOCUMENTS 3-247828 11/1991 Japan .
1602537 11/1981 United Kingdom .

*Primary Examiner*—A. Michael Chambers
*Attorney, Agent, or Firm*—Kanesaka and Takeuchi

[57] ABSTRACT

A housing for a vacuum valve unit is cylindrical in shape and made of synthetic resin. A vacuum valve assembly is mounted within the housing. The housing is composed of a pair of identical left and right housing halves shaped such that the housing is axially divided. Ribs are attached to the inner surfaces of the left and right housing halves to sandwich the vacuum valve assembly.

7 Claims, 5 Drawing Sheets

HOUSING FOR A VACUUM VALVE UNIT

FIELD OF THE INVENTION AND RELATED ART STATEMENT

The present invention relates to a housing made of synthetic resin and adapted for use in a vacuum valve unit (relay unit) of a vaccum sewage system.

A vacuum sewage system is a system that collects sewage by creating a vacuum, referred to as any subatmospheric pressure rather than perfect vaccum, in a sewer to utilize pressure differential between the sewer and the atmosphere.

FIG. 3 shows the structure of such a vacuum sewage system.

Sewage discharged from domestic or industrial sanitary appliances flows into a vacuum valve unit (relay unit) 10 through a drain pipe 8. The sewage is delivered from the vacuum valve unit 10 through a vacuum sewer 14 to a vacuum station 16. A pump 18 pumps the sewage to a sewage disposal plant through a delivery pipe 20.

In the vacuum station 16, the sewage in a tank 24 is fed to an ejector 26 under the action of a sewage circulation pump 22 so as to create a vacuum in the vacuum sewer 14 to collect the sewage in the vacuum station 16.

The vacuum valve unit 10 acts as a relay unit between a source of sewage and the vacuum station 16 and comprises, among others, a housing 28 for receiving sewage from the drain pipe 8, a suction pipe 30 for delivering the sewage from the housing 28 to the vacuum sewer 14, a vacuum valve 32 mounted in the suction pipe 30, and a controller 34 for operating the vacuum valve 32. The suction pipe 30, the vacuum valve 32, and the controller 34 cooperate with a tube 31, a pressure pipe 36, and an air pipe 38 which will be explained later, to form a vacuum valve assembly. Subatmospheric pressure in the vaccum sewer 14 serves as a source of power to drive the vacuum valve 32.

FIGS. 4 to 6 are detailed views of the vaccum valve unit 10 in use. As shown in FIGS. 4 and 5, the level of sewage in the housing 28 gradually increases as the sewage flows into the housing 28. This results in an increase in the pressure of air confined in the pressure pipe 36. When the air pressure exceeds a threshold level, a disphragm activator provided in the controller 34 is opened to transfer subatmospheric pressure in the vacuum sewer 14 to the vaccum valve 32 through the vaccum tube 31. The sewage in the housing 28 then flows up through the suction pipe 30 and into the vacuum sewer 14.

When a sufficient amount of sewage is delivered out of the housing 28 to reduce the level of sewage in the housing 28 below the lower end of the pressure pipe 36, the pressure in the pressure pipe 36 is lowered to close the vaccum valve 32.

When the sewage flows through the suction pipe 30, air is introduced from the air pipe 38 to produce a mixture of air and sewage. This mixture is delivered to the vaccum sewer 14.

The vacuum sewer 14 has airlift portions 14*a*. The sewage flows upwardly through the airlift portions 14*a* under the influence of air bubbles. A combined vaccum and airlift action insures long transfer of sewage.

The vacuum sewage system does not require a continuously inclined pipe as in a sewage system of the type in which sewage flows under gravity and has the following advantages.

(1) The depth of sewer pipes embedded in the ground is shallow. This results in a substantial decrease in the cost of building sewer pipes.

(2) It is possible to build sewer pipes in a place where it is considered difficult to build sewer pipes, for example, where the level of underground water is deep, or where it is difficult to dig in the ground due to rocks.

(3) It is easy to build sewer pipes even in winding alleys.

(4) A mixture of air and sewage under vacuum is used to cause rapid collection of sewage in an intermittent manner. This prevents clogging of sewer pipes and enables the use of small diameter sewer pipes.

In FIGS. 4 to 6, the controller 34 is provided with the diaphragm activator. Attempts have also been made to move up a float along a rod to operate a level sensor as a controller.

The housing 28 of the vacuum valve unit is made of concrete or synthetic resin such as fiber reinforced plastic. As disclosed in Japanese laid-open patent publication No. Hei 3-247828, a plurality of annular elements are joined in a construction site to form a housing made of synthetic resin. This is because a mold should have draft where a housing is made of fiber reinforced plastic.

In the prior art housing made of synthetic resin, after a plurality of housing elements are joined in a construction site to form a housing, a vacuum valve and a controller are mounted within the housing. This, however, results in an increase in the amount of work in a construction site and thus, the construction cost as well as time.

OBJECT AND SUMMARY OF THE INVENTION

It is an object of the present invention to provide a housing for a vacuum valve unit, which reduces number of molds required to form a housing and thus, the cost of molds.

Another object of the present invention is to provide a housing for a vacuum valve unit which has no undercuts and facilitates molding of the housing.

The present invention provides a housing for a vacuum valve unit. The housing contains a vacuum valve assembly therein and is cylindrical in shape and made of synthetic resin. The housing is composed of a pair of identical left and right housing halves shaped such that the housing is axially divided into two pieces. The left and right housing halves include ribs in their inner surfaces to sandwich the vacuum valve assembly.

With the housing of the vacuum valve unit of the present invention, the left and right housing halves are joined to cause the ribs to sandwich principal parts of the vacuum valve unit. This arrangement reduces the number of assemblage steps.

PREFERRED EMBODIMENTS OF THE INVENTION

Figure 1:
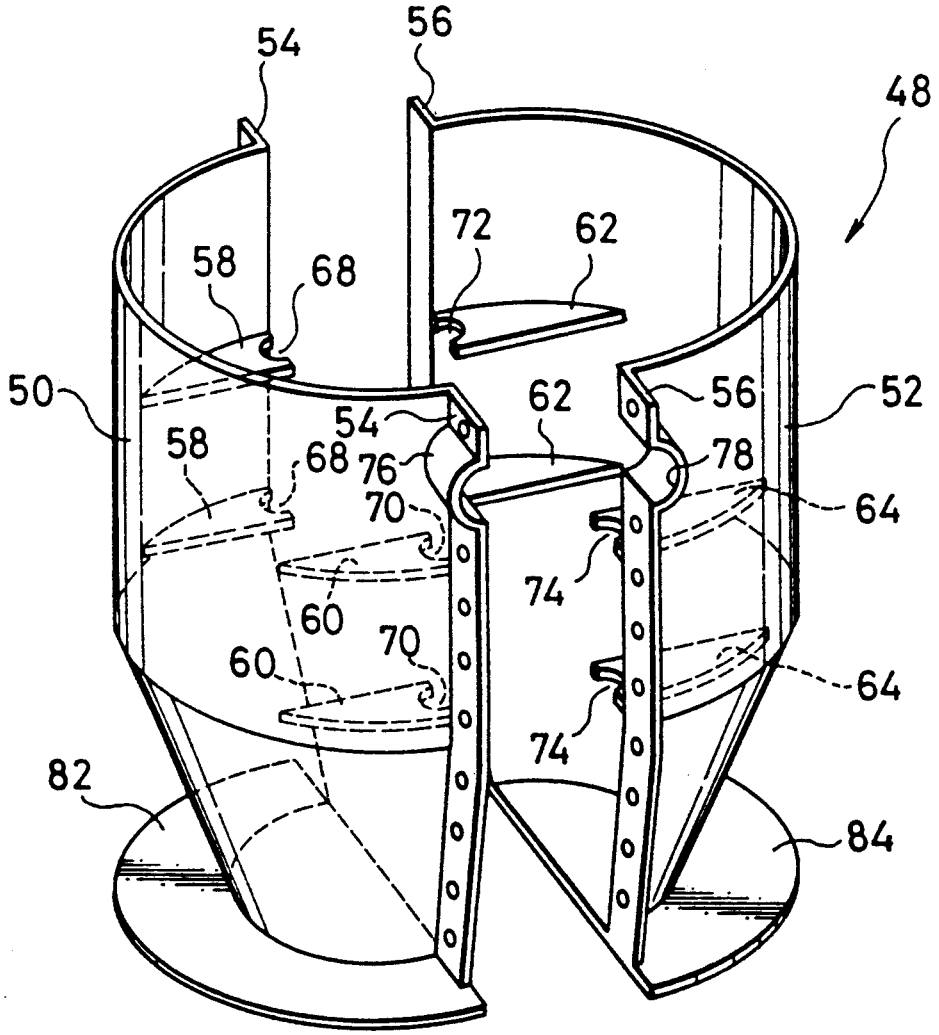
FIG. 1 is an exploded view, in perspective, of a housing of a vaccum valve unit, made according to one embodiment of the present invention.
Figure 2:
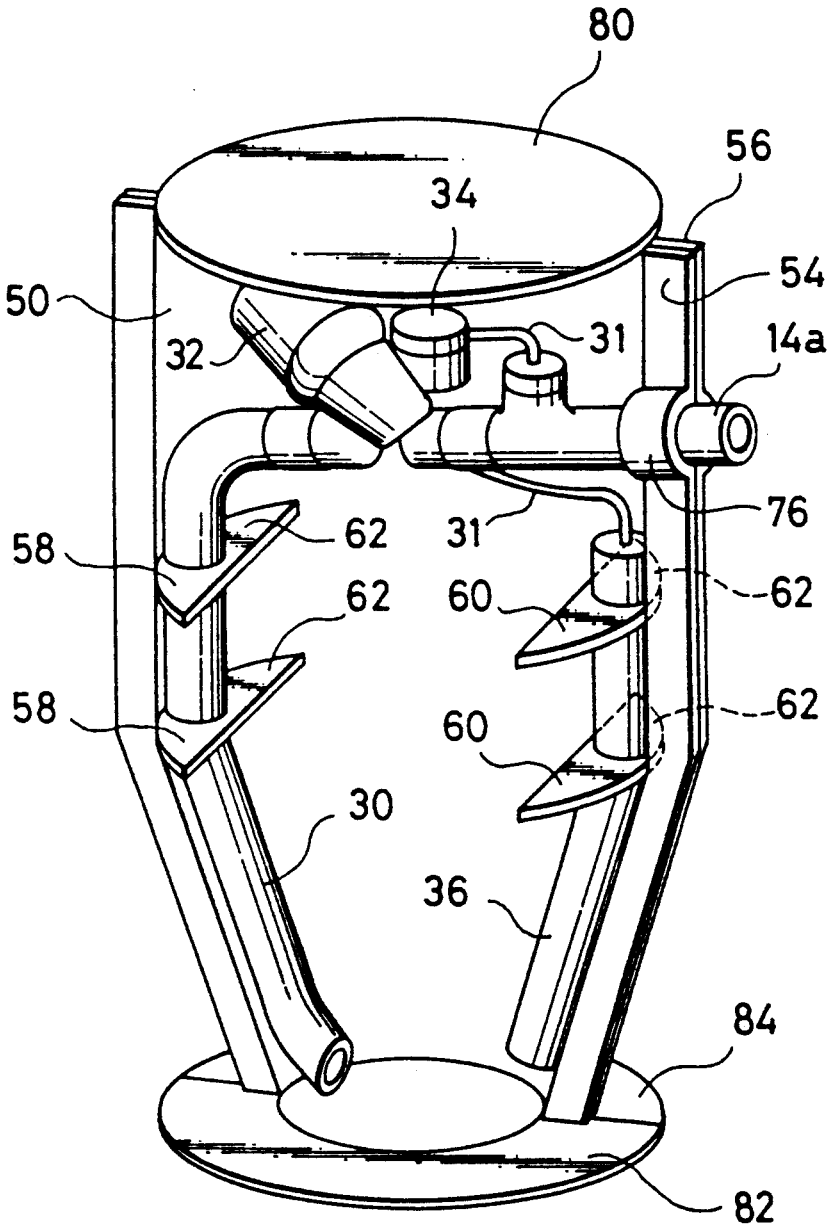
FIG. 2 is a perspctive view of a vacuum valve unit with a portion of the housing broken away to show the interior of the housing.
Figure 3:
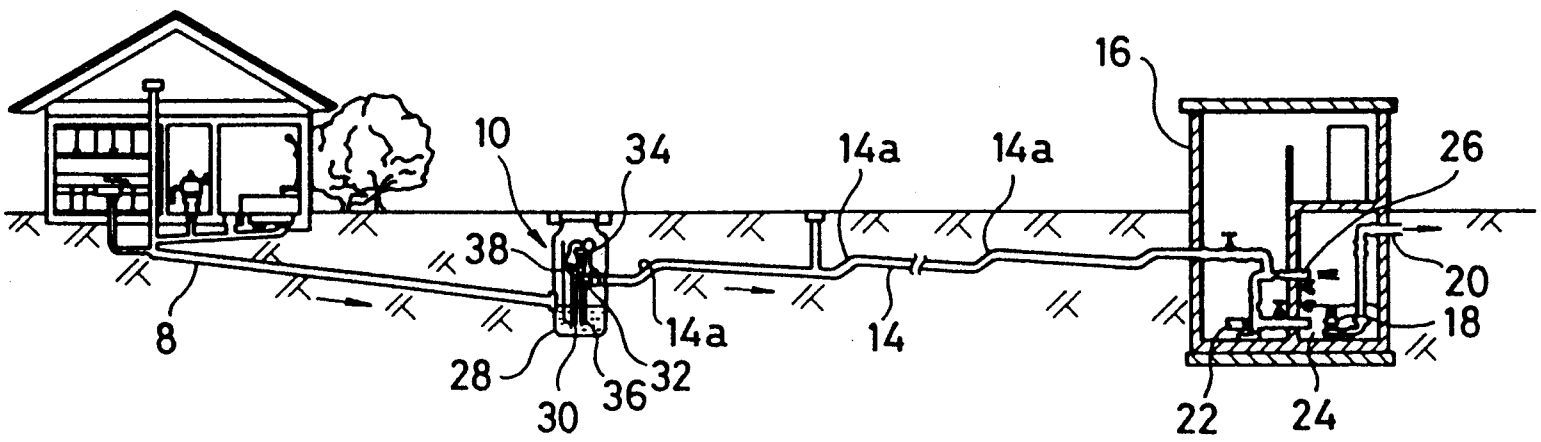
FIG. 3 PRIOR ART
FIG. 3 illustrates a vacuum sewage system.
Figure 4:
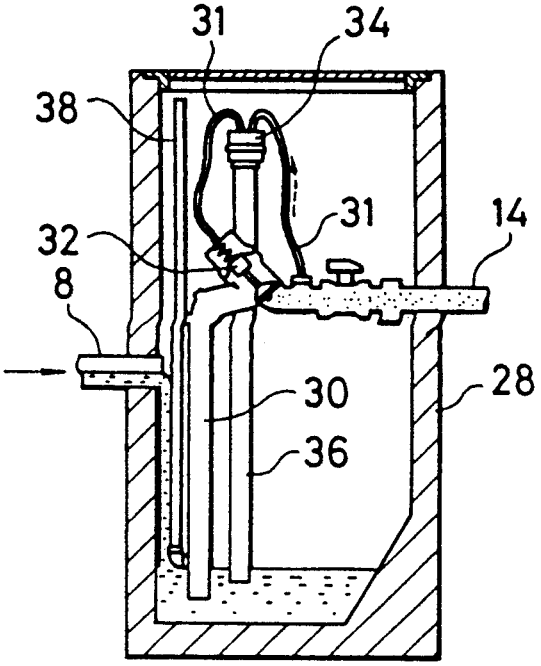
FIG. 4 PRIOR ART
FIG. 4 illustrates a conventional vaccum valve unit in use.
Figure 5:
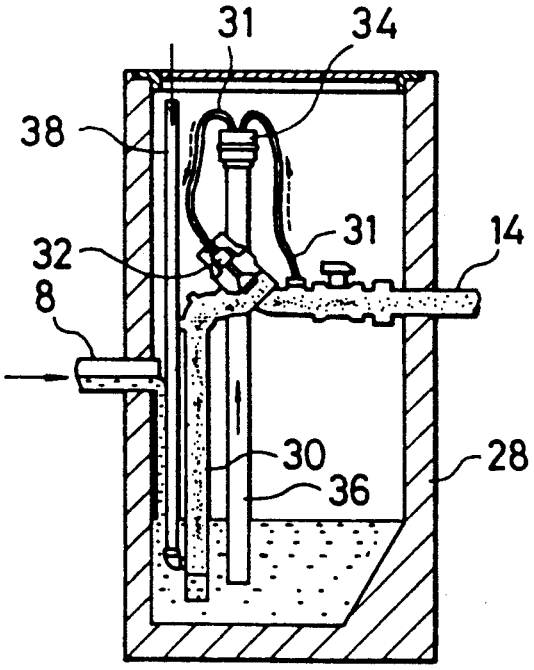
FIG. 5 PRIOR ART
FIG. 5 illustrates the conventional vaccum valve unit in use.
Figure 6:
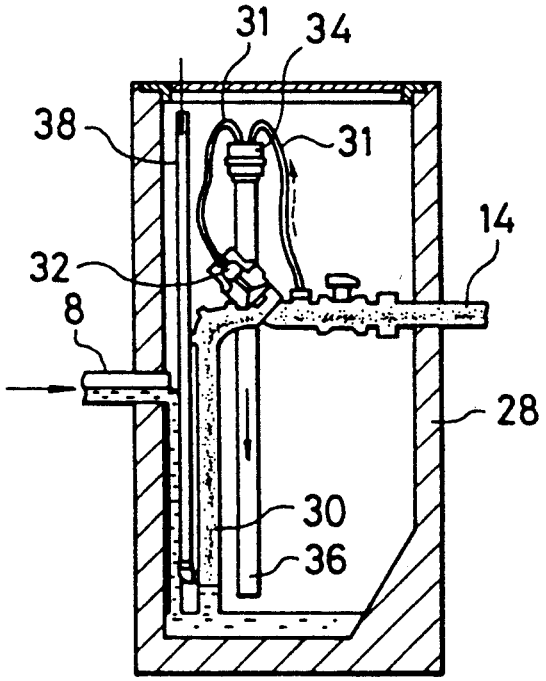
FIG. 6 PRIOR ART
FIG. 6 illustrates the conventional vaccum valve unit in use.

Referring to FIGS. 1 and 2, a vaccum valve unit has a housing 48. The housing 48 has an open top and a closed bottom and are axially divided to provide a pair of identical left and right housing halves 50 and 52. These housing halves 50 and 52 are made of synthetic resin and have flanges 54 and 56, respectively. The flanges 54 and 56 are bolted to join the left and right housing halves 50 nd 52 through packings.

The left housing half 50 has horizontal ribs 58 and 60, and the right housing half 52 has horizontal ribs 62 and 64. Recesses 68 and 70 are formed in the free ends of the ribs 58 and 60, respectively where the left and right housing halves 50 and 52 are joined together. Similarly, recesses 72 and 74 are formed in the free ends of the ribs 62 and 64, respectively. When the left and right housing halves 50 and 52 are joined together, the recesses 68 and 72, and the recesses 70 and 74 define circular openings.

The flanges 54 and 56 have concaved portions 76 and 78, respectively.

In assembly, one of the left and right housing halves 50 and 52 (for example, the left housing half) is first laid down with its longitudinal bisector up. The pressure pipe 36 and the suction pipe 30 are fit in the recesses 68 and 70 of the ribs 58 and 60, respectively. The pressure pipe 36 and the suction pipe 30 are connected to the vacuum valve 32 to form an integral vacuum valve assembly.

Packings are placed on the flanges 54 (The packings may previously be attached to the flanges 54). Then, the right housing half 52 with its longitudinal bisector down is placed on the left housing half 50. At this time, the recesses 72 and 74 of the ribs 62 and 64 are fit over the pressure pipe 36 and the suction pipe 30.

The flanges 54 of the left housing half 50 and the flange 56 of the right housing half 52 are bolted together so as to cause the ribs 58 and 62 and the ribs 60 and 64 to sandwich the pressure pipe 36 and the suction pipe 30, respectively. The vacuum valve assembly is therby fixed within the housing 48.

The left housing half 50 or the right housing half 52 should have an opening to receive the drain pipe 8.

A lid 80 is attached to the housing 48. The housing 48 is thereafter embedded in the ground. This completes assembly of the vacuum valve unit. The left and right housing halves 50 and 52 have end fins or projections 82 and 84 to prevent the housing from being lifted in the ground.

According to the invention, synthetic resin is used to form the left and right housing halves. This resin may or may not be reinforced by fiber.

In the foregoing embodiment, the left and right housing halves have integral bottoms. As an alternative, a separate plate may be attached to the lower end of the housing to form its bottom.

Although not clearly shown, a variety of reinforcing ribs may be attached to the left and right housing halves.

It is, also, clear that flexible rubber packings may be mounted to the inner surface of each of the recesses 68, 70, 72 and 74.

In the foregoing embodiment, the ribs are used to sandwich the pressure pipe and the suction pipe. These ribs may also be used to sandwich other portions of the vacuum valve assembly.

As stated above, the housing of the vacuum valve unit according to the present invention has a pair of identical left and right housing halves. This arrangement reduces types of molds required to form the housing. As the left and right housing halves are shaped such that a cylindrical housing is axially divided, no undercuts are formed. This facilities molding of the housing.

According to the present invention, the vacuum valve assembly is fixed within the housing when the left and right housing halves are joined together. This arrangement makes it easier to assemble the vaccum valve unit.

I claim:

1. A housing made of synthetic resin and adated for use in a vacuum valve unit of a vacuum sewage system, comprising:

a left housing half including a semicylindrical body, two flanges extending outwardly from opposite edges of said body, ribs attached to the inner peripheral surface of said body adjacent to said opposite edges of said body and extending horizontally when said housing is arranged in an upright position, semicircular recesses defined in free ends of said ribs, and a semicircular concaved portion formed in one of said flanges;

a right housing half completely identical in shape to said left housing half;

said flanges of said left and right housing halves being matingly connected by connecting means so that said left and right housing halves form a cylindrical housing;

said concaved portions defining an opening to receive a pipe when said flanges are mated together; and said free ends of said ribs being brought into contact with each other when said left and right housing halves are connected together whereby said semicircular recesses in said free ends of said ribs define openings to receive pipes.

2. The housing of claim 1, wherein said plurality of ribs are attached to side edges of said left and right housing halves in a vertically spaced relationship.

3. The housing of claim 1, wherein said left and right housing halves, respectively have semicircular bottoms.

4. The housing of claim 1, wherein said left and right housing halves have upper portions shaped such that a straight cylinder is axially divided, and lower portions converging in a downward direction.

5. The housing of claim 1, wherein fins extend from the lower portions of said left and right housing halves.

6. The housing of claim 2, wherein a pressure pipe is sandwiched between said ribs adjacent to one side edge of said left and right housing halves, and a suction pipe is sandwiched between said ribs adjacent to the other side edge of said left and right housing halves.

7. The housing of claim 6, wherein a sewer passes through said circular openings formed by said recesses of said ribs, and wherein a vacuum valve is mounted within said housing, said suction pipe and said sewer being connected to hold said vacuum valve.

* * * * *